United States Patent [19]

Lewis

[11] 4,403,542

[45] Sep. 13, 1983

[54] BALE STRAPPING SYSTEM

[75] Inventor: Charles B. Lewis, West Linn, Oreg.

[73] Assignee: Cranston Machinery Company, Inc., Oak Grove, Oreg.

[21] Appl. No.: 298,497

[22] Filed: Sep. 1, 1981

[51] Int. Cl.[3] ..... B65B 13/14

[52] U.S. Cl. ..... 100/2; 100/3; 100/4; 100/26

[58] Field of Search ..... 100/1, 2, 3, 4, 8, 11, 100/24, 25, 26; 53/589, 590, 592

[56] References Cited

U.S. PATENT DOCUMENTS

| | | | |
|---|---|---|---|
| 321,542 | 7/1885 | Sheppard | 100/11 |
| 3,443,512 | 5/1969 | Sauer | 100/26 |
| 3,521,550 | 7/1970 | van Doorn et al. | 100/26 |
| 3,720,158 | 3/1973 | Sauer | 100/26 X |
| 3,834,297 | 9/1974 | Huson | 100/26 |
| 3,889,584 | 6/1975 | Wiklund | 100/26 |
| 3,929,063 | 12/1975 | Stromberg | 100/26 |
| 3,999,476 | 12/1976 | Thompson | 100/26 X |
| 4,018,146 | 4/1977 | Evans | 100/26 |

*Primary Examiner*—Billy J. Wilhite

*Attorney, Agent, or Firm*—Lee R. Schermerhorn

[57] ABSTRACT

A pair of strapping carriages move in one direction from station to station along opposite sides of the bale applying straps simultaneously in different positions from said opposite sides of the bale at each station. The carriages continue to a rest station beyond one end of the bale for removal of the strapped bale and placement of the next bale to be strapped. Then the carriages move in the opposite direction from station to station along said next bale applying pairs of straps in like manner and continue to a rest station beyond the opposite end of the bale. Improved strap guide tracks and strap length adjustment means are provided.

13 Claims, 15 Drawing Figures

K — KNOTTER

G — WIRE GUIDE

FIG. 9
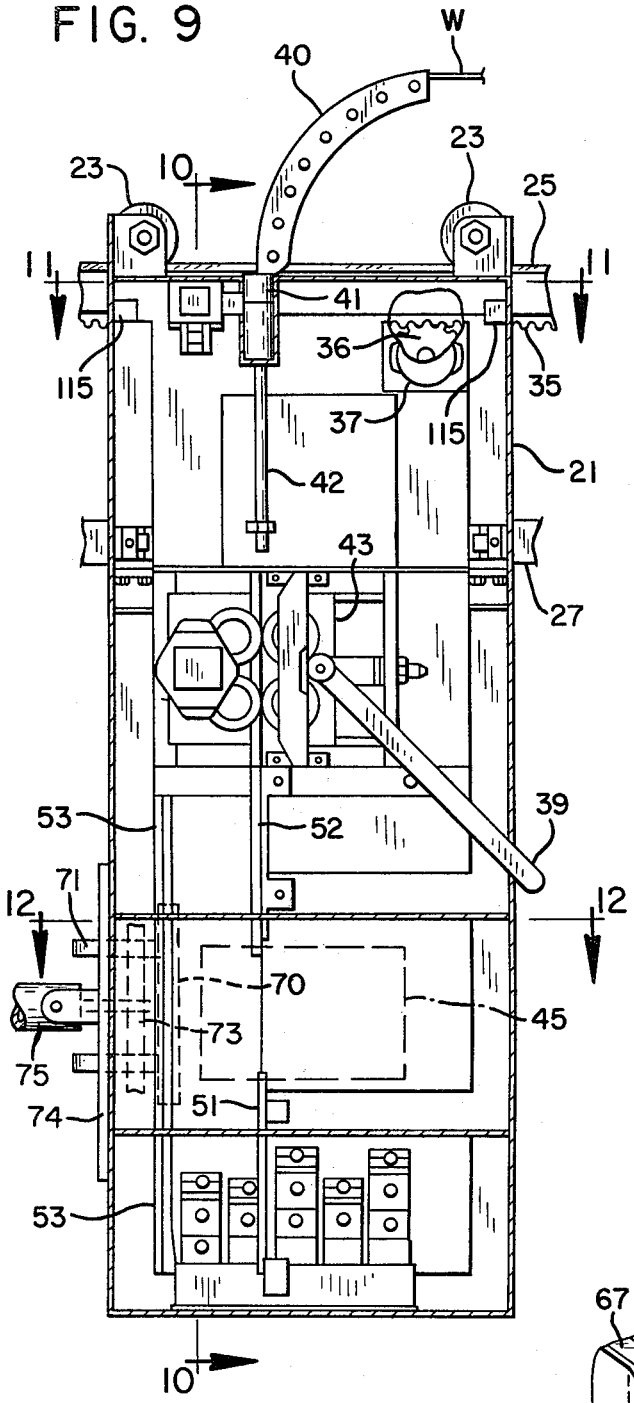
FIG. 10
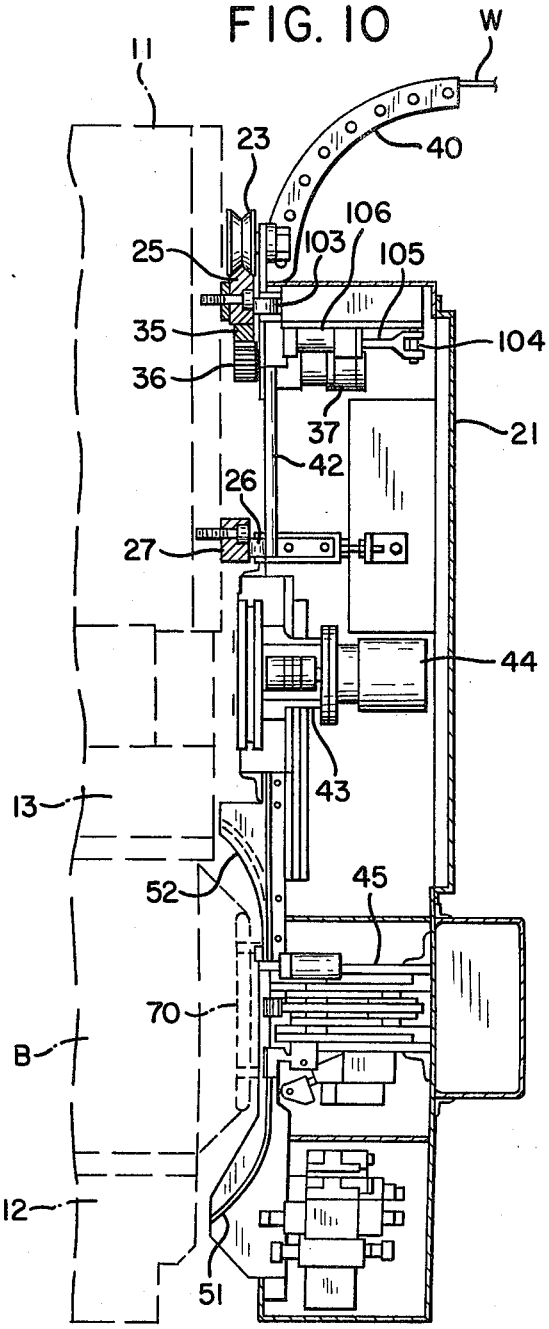
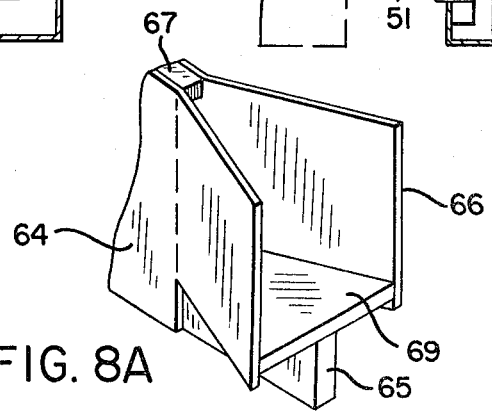
FIG. 8A

BALE STRAPPING SYSTEM

BACKGROUND OF THE INVENTION

This invention relates to a system and apparatus for strapping bales of resilient material such as cotton or synthetic fibers.

It has heretofore been proposed to move a strapping carriage in intermittent motion along the front side of a bale of material to apply straps around the bale at intervals and then return the carriage to its starting position beyond one end of the bale in preparation for strapping the next bale in the same manner.

There is a need for a machine which will accomplish a bale strapping operation with greater efficiency and in less time, not requiring the carriage to stop at each strap position along the bale and not requiring the carriage to return to its starting position after each bale is strapped.

There is also a need for improved guide tracks to guide the strap around the bale in each strapping position and to provide strap length adjustment means to control the strap tension when the strap is secured around the bale, as well as other improvements in the general efficiency and speed of operation of the machine.

SUMMARY OF THE INVENTION

In the present system two strapping carriages are provided, one arranged for travel along the front side of the bale and a second arranged for travel along the back side of the bale. The carriages move from a rest position beyond one end of the bale and stop at a first strapping station. Then the front carriage applies a strap around the bale at one strap position and the back carriage applies a strap around the bale at another strap position whereby two straps are applied simultaneously in two different positions.

Then both carriages move to a second strapping station and two more straps are applied in two different positions, one being applied from the front side of the bale and the other being applied from the back side of the bale. This intermittant operation is continued until the desired number of straps have been applied, with the strapping carriages stopping at a number of strapping stations equal to half the number of straps applied to the bale.

The carriages do not return to their starting positions at the said one end of the bale but continue in the direction of travel to a second rest position beyond the opposite end of the bale. The strapped bale is removed and the next bale is placed in position to be strapped.

Then the carriages move in the opposite direction from one strapping station to the next aplying two straps at two different positions on the bale at each strapping station. When this strapping operation has been completed, with the carriages again stopping at a number of strapping stations equal to half the number of straps applied to the bale, the carriages continue in the said opposite direction to their original starting or rest position beyond the said one end of the bale.

An improved strap guide prevents the strap from being deflected out of the plane of the strap guide during the stripping operation, to avoid problems encountered in conventional apparatus. A novel strap length adjustment provides convenient and efficient means for controlling the strap tension on the bale.

The invention will be better understood and additional objects and advantages will become apparent from the following description of the preferred embodiment illustrated in the accompanying drawings. Various changes may be made in the details of construction and arrangement of parts and certain features may be used without others. All such modifications within the scope of the appended claims are included in the invention.

BRIEF DESCCRIPTION OF THE DRAWINGS

FIG. 8A is an isometric view of the bell mouth end of the strap guide in FIG. 8.

FIG. 9 is a front elevation view of one of the strapping carriages with parts broken away.

FIG. 10 is a view on the line 10—10 in FIG. 9.

DESCRIPTION OF THE PREFERRED EMBODIMENT

Figure 2:
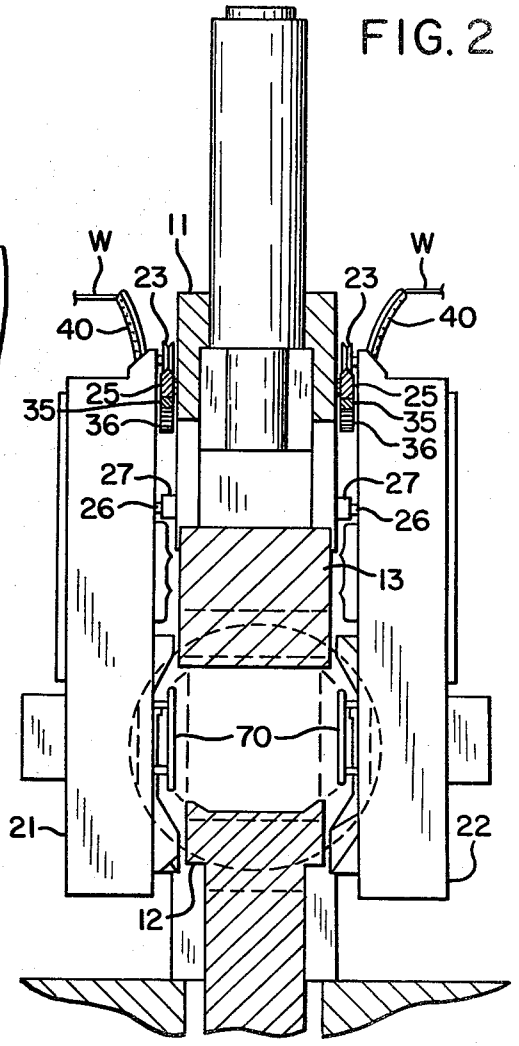
FIG. 2 is a view on the line 2—2 in FIG. 1.

By way of example the present system and apparatus is illustrated and described in the drawings and specification as applied to a conventional cotton gin press. The strapping material is round steel wire and the system is fully automatic. The strapping cycle is automatically started when the press follower reaches the preset bale compression setting and after the strapping is completed the system signals the press to eject the bale and continue its function of preparing another bale for strapping. No operator intervention or attention is required.

The system comprises essentially a pair of traveling strapper carriages which travel on rails mounted on opposite sides of the press. Each carriage contains a wire feeding and tensioning unit, a hydraulically powered mechanical knotter unit, wire control tracks, carriage travel motor, carriage index and locking mechanism, hydraulic control valving and a manual function push-button control unit.

Figure 1:
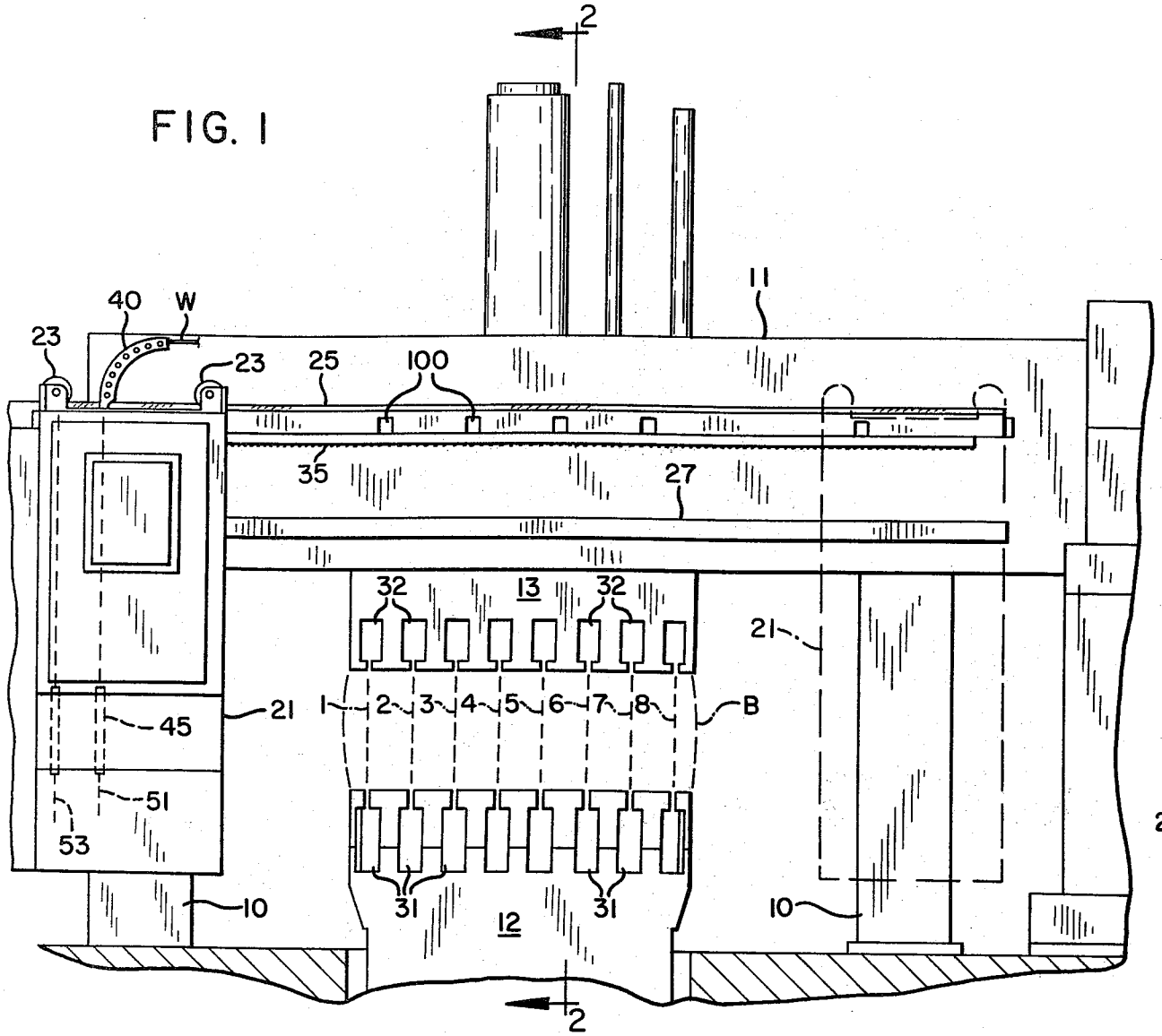
FIG. 1 is a front elevation view of a bale strapping apparatus emboding the invention.

As shown in FIGS. 1 and 2 the press has a main frame 10 spanned by a horizontal top beam 11. A bale B in position for strapping is compressed between a lower platen 12 and upper platen 13.

A strapping carriage 21 travels along the front side of the bale and an identical strappping carriage 22 travels along the back side of the bale. Each carriage is supported by a pair of V-wheels 23 which ride on an upper rail 25 mounted on beam 11. The carriages are stabilized by rollers 26 which bear against the vertical sides of lower rails 27. Thus the two carriages travel along opposite sides of the bale B to bind the bale with straps as indicated by the strap positons 1–8. In order to guide the straps around the bale the lower platen 12 contains a guide track 31 and the upper platen 13 contains a guide track 32 at each strap position.

As shown in FIG. 9 the underside of each upper rail 25 is provided with a travel rack having teeth 35 engaged by a gear 36 driven by a reversible hydraulic motor 37 to move the carriage along the rail.

At the top of each carraige a wire feed goose-neck 40 is mounted on a pivotal spindle 41 to feed the wire W through feed tube 42 into a conventional wire drive unit 43 powered by hydraulic motor 44. The wire is supplied from conventional wire spools (not shown) adjacent the press. Handle 39 retracts a pair of rollers in the wire drive assembly for threading in a new wire.

Figure 12:
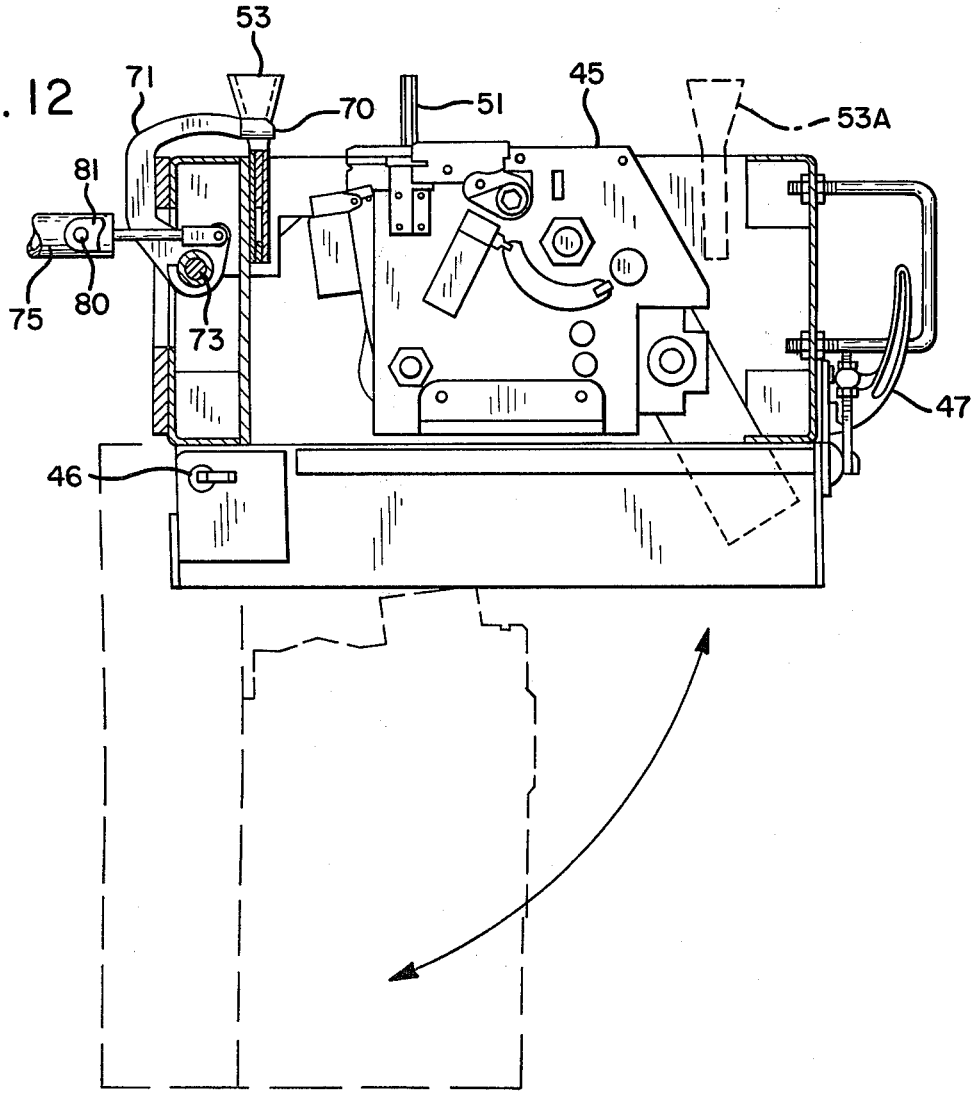
FIG. 12 is a view on the line 12—12 in FIG. 9.

The wire W then passes to knotter unit 45 which in the present illustration is a Cranston hydro-mechanical TWIST LOCK knotter, Model 62A012. The knotter unit may be swung out from the carriage on pivot pin 46 for service and repair as shown in FIG. 12, by releasing knotter mount latch 47.

Each carriage includes two separate sets of wire control tracks. One set guides the wire from the wire drive unit 43 to the knotter unit 45, guides the wire from knotter unit 45 through track 51 in FIG. 10 into the previously mentioned track 31 in the lower press platen 12, and then guides the wire from a guide track 32 in the upper press platen through a track 52 back into the knotter unit 45.

Figure 3:
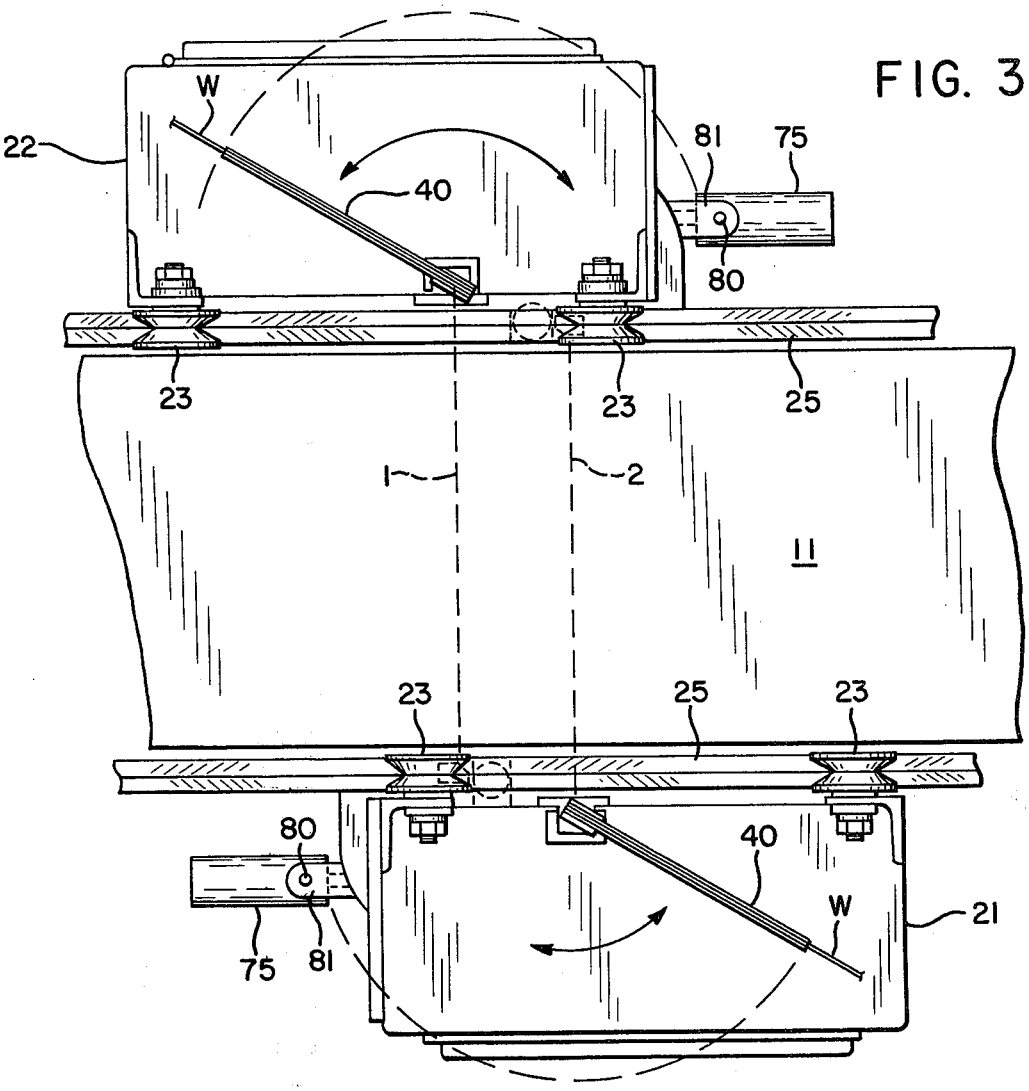
FIG. 3 is a fragmentary top plan view.
Figure 6:
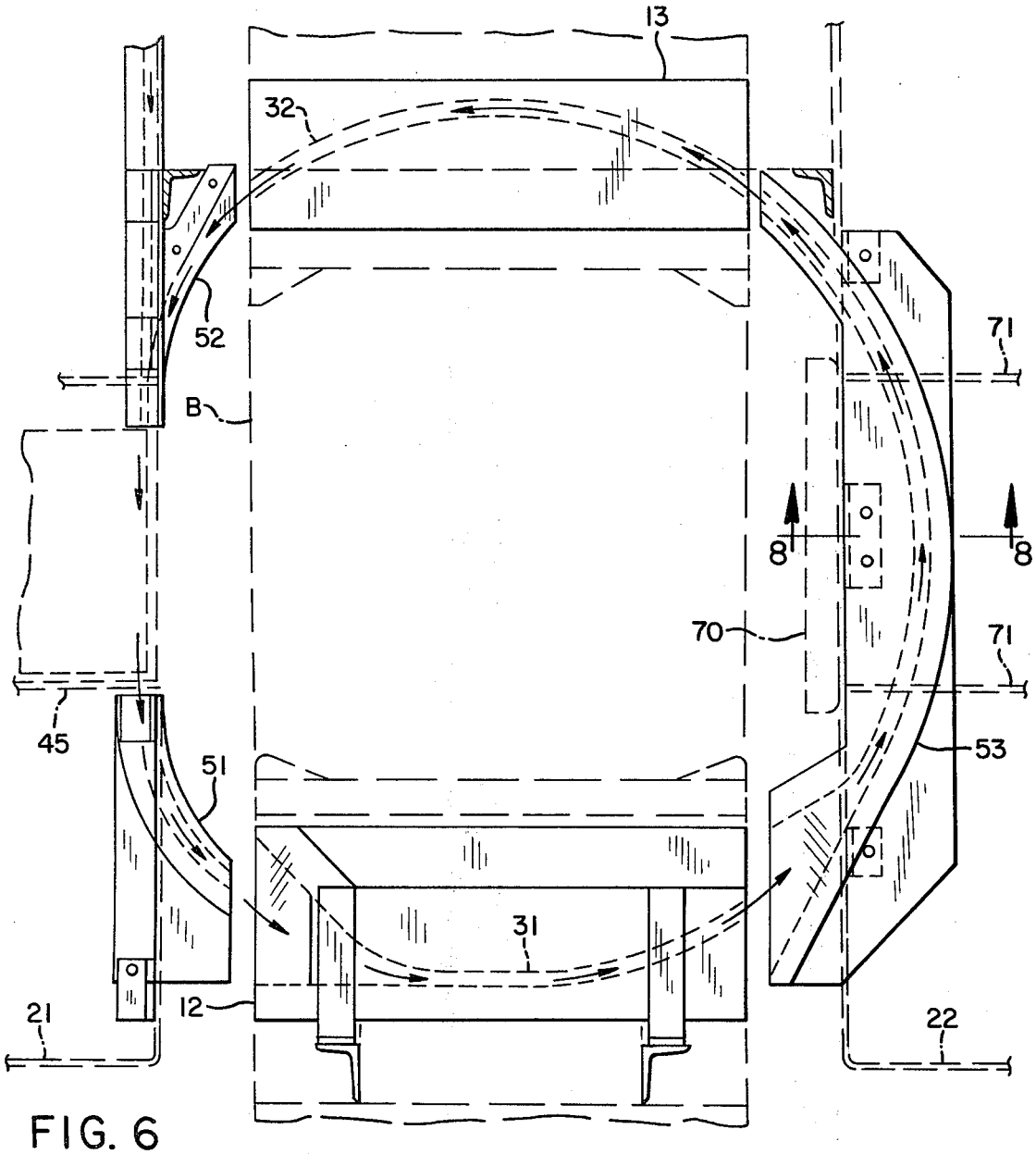
FIG. 6 is a vertical sectional view through the two strapping carriages at a strapping station.

The other set of wire control tracks guides the wire from the opposite strapper, from lower platen track 31 up the side of the bale through a track 53 and back over the bale through the track 32 in the upper press platen. See FIGS. 6 and 9. Thus the lateral spacing of the two sets of wire control tracks in each carriage conforms to the spacing of wire positions 1 and 2 in FIG. 1. See FIGS. 3 and 9.

WIRE TRACKS

Figure 7:
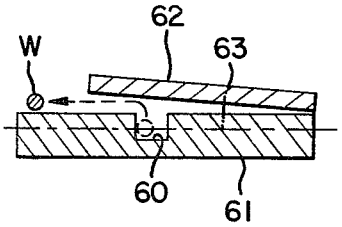
FIG. 7 PRIOR ART
FIG. 7 is a cross sectional view of a conventional form of strap guide.

FIG. 7 shows the conventional form of wire track in which the wire groove 60 is machined in a heavy plate or bar 61. A movable cover plate 62 forms a closed passageway for the wire W. In operation, the wire is stripped from this groove by means of a ramp on one end of the groove wall. When the wire is tensioned it climbs the ramp and forces the cover open as shown.

This arrangement has two drawbacks when used on a cotton baling strapper. First, when the wire climbs the ramp to force open the cover it becomes laterally offset from the plane 63 of passageway. This creates a problem because the wire must then be forced by some other means to move back to the original feeding plane in order to escape from the narrow grooves in the platens of the baling press and be pulled against the bale.

Second, it is not possible to use only narrow grooves just slightly larger than the size of the wire used in cotton strapping because the various sections of wire tracks are not always located exactly in the same place relative to one another; i.e., one portion of the track is on the traveling strapper itself, one portion is located in the moving bottom platen of the bale press and varies in location directly with variations in the height of the bale, one portion is located in the opposite traveling strapper, and the remaining portion is located in the moving top platen of the press. To accommodate changes in bale sizes and inaccuracies in the exact alignment of the strappers, the wire guides must have large bell mouths at their wire entry ends.

Because these wire tracks must be highly resistant to abrasion, (to resist wear from the pressure of the cut wire end traveling through them hundreds of thousands of times) the wire tracks are generally manufactured from special abrasion resistant steel which is difficult and expensive to machine. It therefore becomes prohibitive in cost to manufacture these tracks by the conventional method of machining away large portions to create bell mouths, particulary when considering that there are thirty separate and complete track assemblies in a strapper installation.

Figure 8:
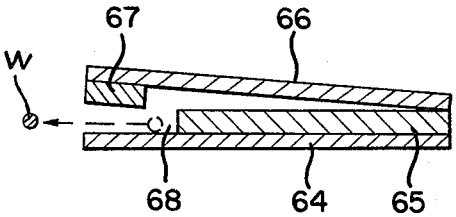
FIG. 8 is a similar view of a strap guide in the present apparatus taken on the line 8—8 in FIG. 6.

Both of these problems are overcome by the new form of wire track shown in FIG. 8. Here the track comprises essentially a lamination of a relatively thin back plate 64 and a spacer plate 65. Movable cover plate 66 carries an abutment wall plate 67 which then forms the wire passageway 68. This construction requires only sawing and no expensive milling of hard abrasion resistant steel.

This form of construction eliminates the change in plane of the wire during strapping by placing the wall of the wire passageway past which the wire must strip on the movable cover. In operation, the wire then uses the ramp on the cover wall to force the cover open. The wire strips directly out of the passageway without changing planes and can, therefore, pass through the narrow press platen slot without damaging the wire or applying additional forces to the wire tracks.

The second problem mentioned above is resolved by the combination of the laminate design and by adding a wedge-shaped piece 69 to the end of the track core laminate to provide the required bell mouth opening as shown in FIG. 8A. Any required size of bell mouth can be obtained inexpensively in this way. Where this bell mouth occurs, the outer laminate of both track 64 and track cover 66 are simply bent outward to conform to the wedge-shaped piece 69. Thus, any configuration of passageways may be formed economically, not just sraight grooves and arcuate grooves. The laminates may be joined by welding, bolting, riveting, bonding or other appropriate means.

The guide tracks 31 and 32 in the platens are the type shown in FIGS. 8 and 8A.

Wire Length Adjustment Device

For various reasons it sometimes becomes desirable or necessary to vary the length of strapping applied to a bale of resilient material. One means for accomplishing this with automatic strappers is to move the traveling strapper mechanism farther away from the bale. This involves considerabe work and can cause problems with the alignment of strap guides as discussed above.

Figure 4:
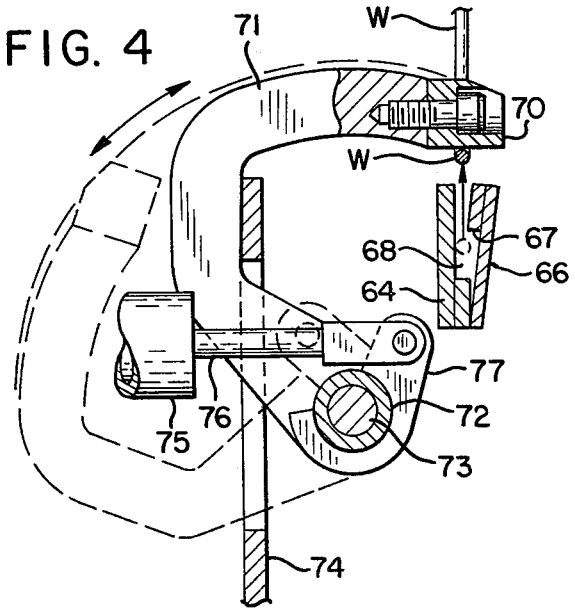
FIG. 4 is a top plan view with parts broken away showing a strap length adjusment.
Figure 5:
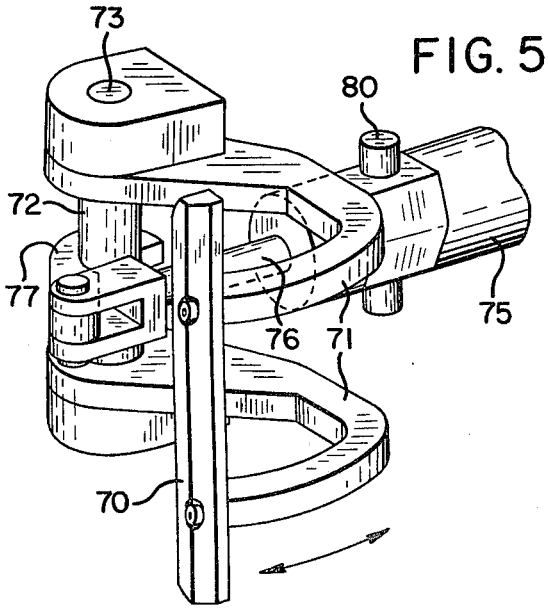
FIG. 5 is an isometric view of the strap length adjustment.

The present wire length adjustment device is illustrated in FIG. 4, 5 and 12. This is a relatively simple device which allows changes in strap length easily and accurately. Rather than allowing the strap to wrap directly on the bale on the face opposite the strapping mechanism, a retractable bar 70 is inserted between the face of the bale and the strap guide on the face of the bale opposite the strapper mechanism.

When the strapping is pulled from the strap guide during the tensioning of the strap around the bale, the strap is held away from the bale by this bar. After the strap is knotted or sealed, the bar is retracted from this position clear of the bale and strap in order to allow the strappers to travel to the next strap position. By providing bars 70 of different lengths the length of strap around the bale may be varied.

Bar 70 is mounted on the ends of a pair of curved arms 71 on a trunion 72 which rotates on a shaft 73. Shaft 73 is supported by a base plate 74 which is mounted on the carriage. Arms 71 and bar 70 are rotated by a hydraulic cylinder 75 having a piston rod 76 connected to an arm 77 on the trunion 72. In solid line position the bar 70 holds a length of wire W away from the bale and in broken line position the bar 70 is retracted away from the wire.

Figure 11:
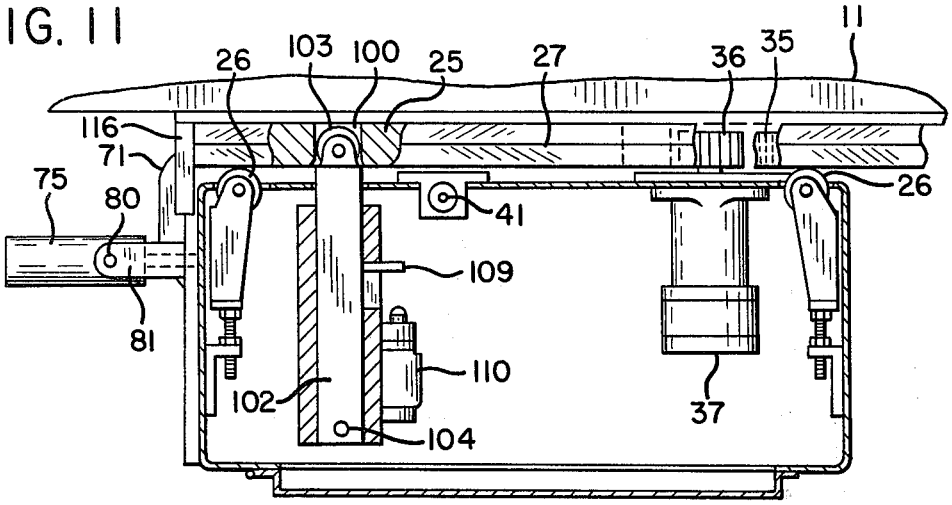
FIG. 11 is a view on the line 11—11 in FIG. 9.

As shown in FIGS. 11 and 12 hydraulic cylinder 75 is supported on pivot pins 80 in a bracket 81 on base plate 74. When bar 70 has been retracted and the compressive pressure of platen 12 and 13 relieved, the resilient bale expands to apply the desired amount of tension to the strap.

Operation

In a wire strapping system the physical size of the knotter units prevents their being mounted side by side close enough to correspond to adjacent strap positions on the bale. Therefore, as previously explained, in the present system two identical strapping carrages travel along opposite sides of the bale, each carriage strapping alternate strap positions along the length of the bale.

Thus, one carriage applies a strap at each odd numbered strap position and the other carriage applies a strap at each even numbered strap position. The carrages move and stop in unison whereby the straps 1 and 2 are applied simultaneously, straps 3 and 4 are applied simultaneously, etc.

Figure 13:
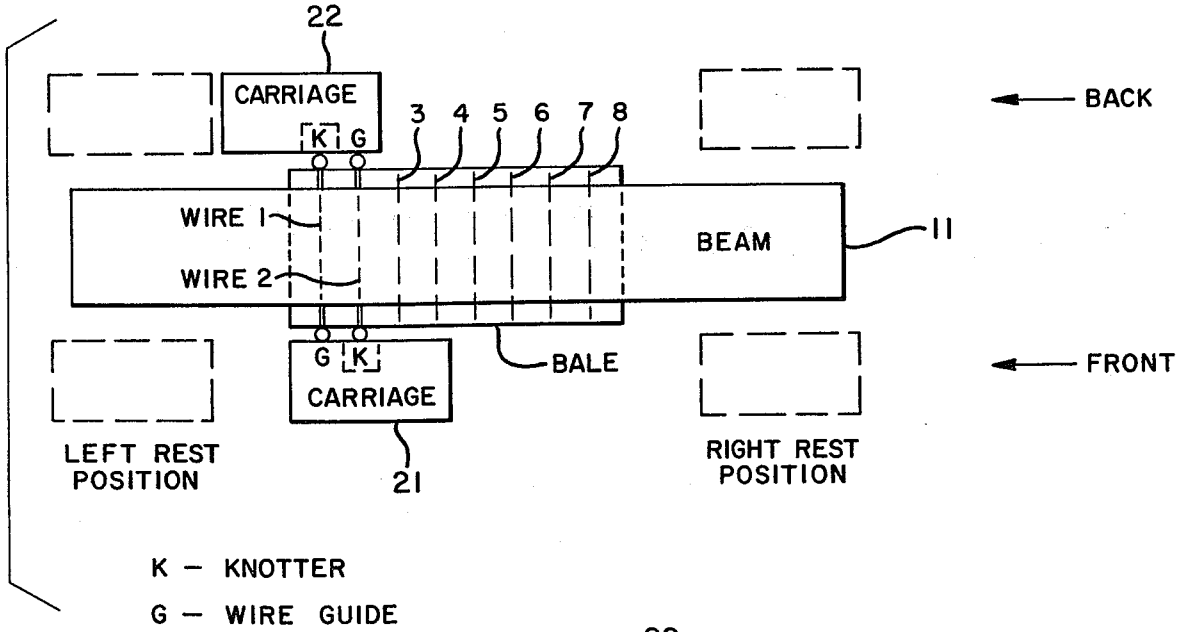
FIG. 13 is a diagramatic top plan view illustrating the mode of operation of the apparatus.

This is illustrated in FIG. 13 where both carriages 21 and 22 have moved from the left rest position to the first strapping station on the bale. Carriage 22 applies wire 1 and carriage 21 applies wire 2. Then both carriages move to the right to the second strapping station where carriage 22 applies wire 3 and carriage 21 applies wire 4. In this manner the carriages move to a third strapping station to apply wires 5 and 6, and to a fourth strapping station to apply wires 7 and 8.

Then both carriages move to the right rest position and remain there while the strapped bale is discharged from the press and a new bale is brought into strapping position. Then both carriages move in reverse direction to a first strapping station where carriage 21 applies wire 8 and carriage 22 applies wire 7. The carriages continue to the left from station to station applying two wires at each station and stop in the left rest position while the strapped bale is discharged and a third bale is brought into position for strapping. This cycle repeats continuously and automatically in response to operation of the press.

In moving from station to station the carriages are stopped and accurately positioned by square holes or notches 100 in upper rail 25 in FIG. 1. FIG. 11 the stop plunger 102 is equipped with a roller 103 arranged to enter holes 100 and hold the carriage at a strapping station. Stop plunger 102 is acutated by a pin 104 conncted to piston rod 105 in hydraulic cylinder 106 in FIG. 10.

Switch 110 controls hydraulic drive motor 37. Retraction of stop 102 by hydraulic cylinder 106, when it is time for the carriage to move, causes pin 109 to actuate switch 110, which starts hydraulic motor 37, causing the carriage to travel along the press between stations. Roller 103 rides against the face of rail 25 unitl the next hole 100 is reached. As roller 103 enters a hole 100, switch 110 is deactuated to stop hydraulic motor 37.

Limit switches 115 in FIG. 9 engage rail stops 116 on upper rail 25 in FIG. 11 in the two rest positions of the carriage to stop hydraulic drive motor 37.

It may sometimes be desirable to apply straps simultaneously in every other strap position instead of in adjacent positions on the bale. This is accomplished by moving strap guide track 53 to position 53A in FIG. 12, which is two strap positions away from guide track 41. By appropriately changing the positions of holes 100 in upper rail 25 in FIG. 1 the carriages 21 and 22 will strap simultaneously at odd numbered wire positions and then at even numbered wire positions as illustrated in FIG. 14.

In this mode of operation there is no left rest position. The carriages move directly from right rest position to the first strapping station as shown where carriage 21 applies wire 1 and carriage 22 applies wire 3. Then both carriages move one wire position to the right to the second strapping station where carriage 21 applies wire 2 and carriage 22 applies wire 4. Both carriages then move to a third station three wire positions to the right, where carriage 21 applies wire 5 and carriage 22 applies wire 7. Then the carriages move one wire position to the right where carriage 21 applies wire 6 and carriage 22 applies wire 8. With the strapping completed, both carriages continue to right rest position.

Figure 14:
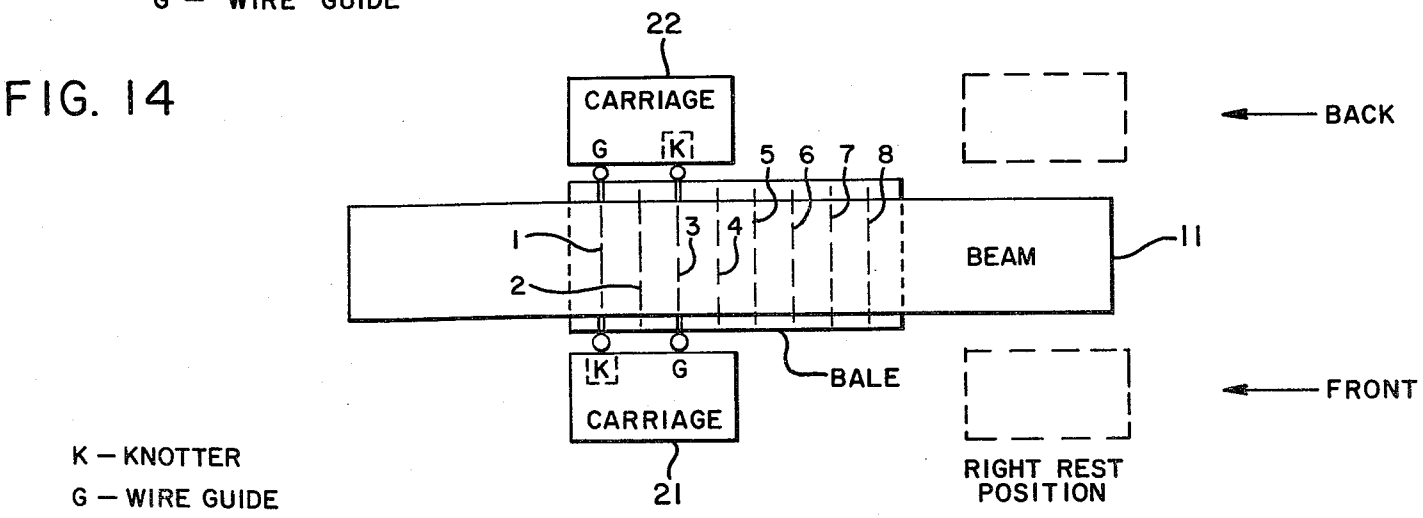
FIG. 14 is a similar diagramatic view illustrating a different mode of operation.

The FIG. 14 mode of operation adapts the present system to cotton baling presses having a door in front of the bale mounted on hinges at the left end of the bale and preventing movement of the carriages 21 and 22 beyond the left end of the bale. At the first strapping station the left sides of both carriages are even with the left end of the bale.

Thus the two modes of operation in FIGS. 13 and 14 speed up the bale strapping operation by applying two straps each time the carriages stop at a strapping station. The FIG. 13 mode of operation has the additional advantage of not requiring the carriages to make an idle traverse back across the bale to original starting positions after each bale is strapped.

The details for the electrical and hydraulic control systems are conventional and will be understood by persons skilled in the art from the foregoing description of the modes of operation. Push button controls are provided for moving the carriages to selected positions and for performing individual machine operations when desired.

The general features of the invention are not limited to wire strapping or a cotton gin press. The same general mode of operation may be accomplished by any suitable type of flat band strapping equipment in the carriages.

What is claimed is:

1. Apparatus for strapping bales of material comprising a pair of carriages movable along opposite sides of the bale to a series of strapping stations, means in one of said carriages for applying a strap around the bale from one side of the bale in one strap position on the bale at each of said stations, and means in the other carriage for applying a strap around the bale from the opposite side of the bale in another strap position on the bale at each of said stations.

2. Apparatus as defined in claim 1, said strap applying means in the two carriages operating simultaneously at each of said stations and said carriages moving in unison from station to station.

3. Apparatus as defined in claim 1 including two rest stations for said carriages beyond opposite ends of the bale.

4. Apparatus as defined in claim 3, said carriages moving in one direction from one of said rest stations to the second rest station in strapping one bale and then moving in the opposite direction from said second rest station back to said one rest station in strapping the next bale.

5. Apparatus is defined in claim 1 including a strap guide on said second carriage for the strap applied by the first carriage, and strap guide on the first carriage for the strap applied by the second carriage.

6. Apparatus as defined in claim 5, said strap guide comprising a lamination of plates to form a wire track wherein one of said plates forms a laterally movable cover for a closed wire passageway between the plates, and a wire retaining wall on said cover plate which is displaced laterally with said cover plate when a wire is stripped from said passageway in strapping the bale, whereby the wire is not deflected out of the plane of the passageway by said retaining wall.

7. Apparatus as defined in claim 5 including strap length adjustment means associated with said strap guides.

8. Apparatus as defined in claim 7, said strap length adjustment means comprising a bar arranged to hold a length of the strap away from the bale when the strap is stripped from its strap guide, and means for retracting said bar away from the strap when the strap has been secured around the bale.

9. Apparatus for strapping bales of material comprising means on opposite sides of the bale for applying straps simultaneously from said opposite sides of the bale in two different positions on the bale at a strapping station, and means for moving said strap applying means along the bale in one direction from one strapping station to another, said moving means moving said strap applying means from the last strapping station to a rest station beyond one end of the bale for removal of the strapped bale and placement of the next bale to be strapped, said moving means moving said strap applying means in the opposite direction along said next bale from one strapping station to another to apply straps in like manner and then moving said strap applying means to a rest station beyond the opposite end of said next bale.

10. The method of strapping a bale of material comprising applying strapping means to opposite sides of the bale, moving said strapping means in one direction along the bale from one strapping station to another, and applying a pair of straps from said opposite sides of the bale in two different positions on the bale at each station.

11. The method of claim 10 including the steps of moving said strapping means to a rest station beyond one end of the bale for removal of the strapped bale and placement of the next bale to be strapped, moving said strapping means in the opposite direction from station to station and applying straps in like manner to said next bale, and then moving said strapping means to a rest station beyond the opposite end of the bale.

12. In a bale strapping system, a carriage arranged to move along one side of the bale from one strapping station to another, means in said carriage for feeding a strap around the bale and securing said strap in a closed loop encircling the bale including one set of guide tracks for said strap, and a second set of guide tracks in the carriage spaced laterally from said one set of guide tracks to receive and guide a strap applied in a different position from the opposite side of the bale.

13. A carriage as defined in claim 12 for strapping with wire, including a pivotal wire feed goose neck on the carriage to receive said wire from an external source and guide the wire into said strap feeding and securing means.

* * * * *